US005713767A

United States Patent [19]

Hanson et al.

[11] Patent Number: 5,713,767

[45] Date of Patent: Feb. 3, 1998

[54] SOCKET CONTACT HAVING SPRING FINGERS AND INTEGRAL SHIELD

[75] Inventors: Theodore George Hanson, Prospect, Conn.; James Valentino, Jr., San Jose, Calif.

[73] Assignee: The Whitaker Corporation, Wilmington, Del.

[21] Appl. No.: 756,323

[22] Filed: Nov. 25, 1996

[51] Int. Cl.[6] ..... H01R 11/22

[52] U.S. Cl. ..... 439/853; 439/381; 439/857

[58] Field of Search ..... 439/853, 851, 439/852, 854, 856, 857, 844, 380, 381, 81, 82, 843

[56] References Cited

U.S. PATENT DOCUMENTS

| | | | |
|---|---|---|---|
| 1,696,616 | 12/1928 | Wappler | 439/844 |
| 3,566,342 | 2/1971 | Schmitt et al. | 439/852 |
| 3,663,931 | 5/1972 | Brown | 439/857 |
| 3,792,412 | 2/1974 | Madden | 439/82 |
| 3,853,389 | 12/1974 | Occhipinti | 439/852 |
| 4,505,531 | 3/1985 | Miller | 439/844 |
| 5,362,244 | 11/1994 | Hanson et al. | 439/82 |

*Primary Examiner*—Neil Abrams
*Assistant Examiner*—Tho D. Ta
*Attorney, Agent, or Firm*—Robert Kapalka

[57] ABSTRACT

A socket contact (4) comprises a unitary contact body (12) including a tubular body portion (20) having a wall (22) which defines an interior space (24) and an open end (25) which permits insertion of a lead (11) of a mating contact into the interior space. The unitary contact body further includes a spring finger (30) extending into the interior space for engagement with the lead of the mating contact, and a shield (40) partially covering the open end and arranged to guide the lead into the interior space. The shield (40) prevents stubbing of the spring finger (30) during insertion of the lead (11).

17 Claims, 5 Drawing Sheets

SOCKET CONTACT HAVING SPRING FINGERS AND INTEGRAL SHIELD

FIELD OF THE INVENTION

The invention relates to a socket-type electrical contact which is formed as a unitary body.

BACKGROUND OF THE INVENTION

U.S. Pat. No. 5,362,244 discloses a socket contact which is formed as a unitary body having a tubular body portion and a plurality of spring fingers which converge for electrically engaging and frictionally retaining a lead which is received in the tubular body portion. A plurality of these contacts can be arranged in the form of a receptacle header that is matable with a pin header having a corresponding plurality of leads or pins. In one arrangement the socket contacts are installed in holes in a circuit board and are oriented such that the tubular body portion forms an entranceway for the lead, and the spring fingers depend downwardly from the tubular body portion and converge at an end of the socket contact opposite from the entranceway. In another arrangement the socket contacts are mounted on a surface of the circuit board and are oriented with the spring fingers extending upwardly from the tubular body portion and converging to define a narrow entranceway for the lead. The upwardly converging second arrangement has the advantage that holes are not required in the circuit board, thereby eliminating a manufacturing step. Also, since the leads are engaged by the socket contacts at the entranceway to the socket contacts, the leads need not be as long as would be required in the case of downwardly converging socket contacts. However, a problem with the upwardly converging arrangement is that the leads may stub the spring fingers during insertion if the leads are not closely aligned with the central axis of the socket contacts. Stubbing the spring fingers may result in crushed or deformed spring fingers which cannot grip the leads and cannot make a good electrical connection.

In order to prevent stubbing of the spring fingers, the '244 patent teaches that socket contacts with upwardly converging spring fingers are held in a plastic housing that has a roof over the spring fingers, and the roof has small apertures which are aligned with the central axis of the socket contacts to guide the leads along a proper insertion path between the spring fingers. The roof of the plastic housing adds to the height of the receptacle header, thereby negating some of the size advantage that stems from having upwardly converging spring fingers. Also, the apertures in the roof must be positioned to close tolerances, thereby adding complexity to manufacture of the plastic housing. There is a need for an improved low profile receptacle header which overcomes these problems.

SUMMARY OF THE INVENTION

The invention is a socket contact comprising a unitary contact body including a tubular body portion having a wall which defines an interior space and an open end which permits insertion of a mating contact into the interior space. The unitary contact body further includes a spring finger extending into the interior space for engagement with the mating contact, and a shield partially covering the open end and arranged to guide the mating contact into the interior space. The shield prevents stubbing of the spring finger during insertion of the mating contact.

In one embodiment the unitary contact body includes a flange extending outwardly from the wall of the tubular body portion, and the shield portion comprises a pair of flaps which are connected to the flange at respective reverse bends. The flaps have ends which abut over the open end, and a cutout in the abutting ends provides an opening for the mating contact to enter the interior space.

The invention may be embodied in an electrical connector comprising a dielectric housing which holds a plurality of the aforementioned socket contacts.

BRIEF DESCRIPTION OF THE DRAWINGS

The invention will now be described by way of example with reference to the accompanying drawings wherein.

DETAILED DESCRIPTION OF THE PREFERRED EMBODIMENT

Figure 1:
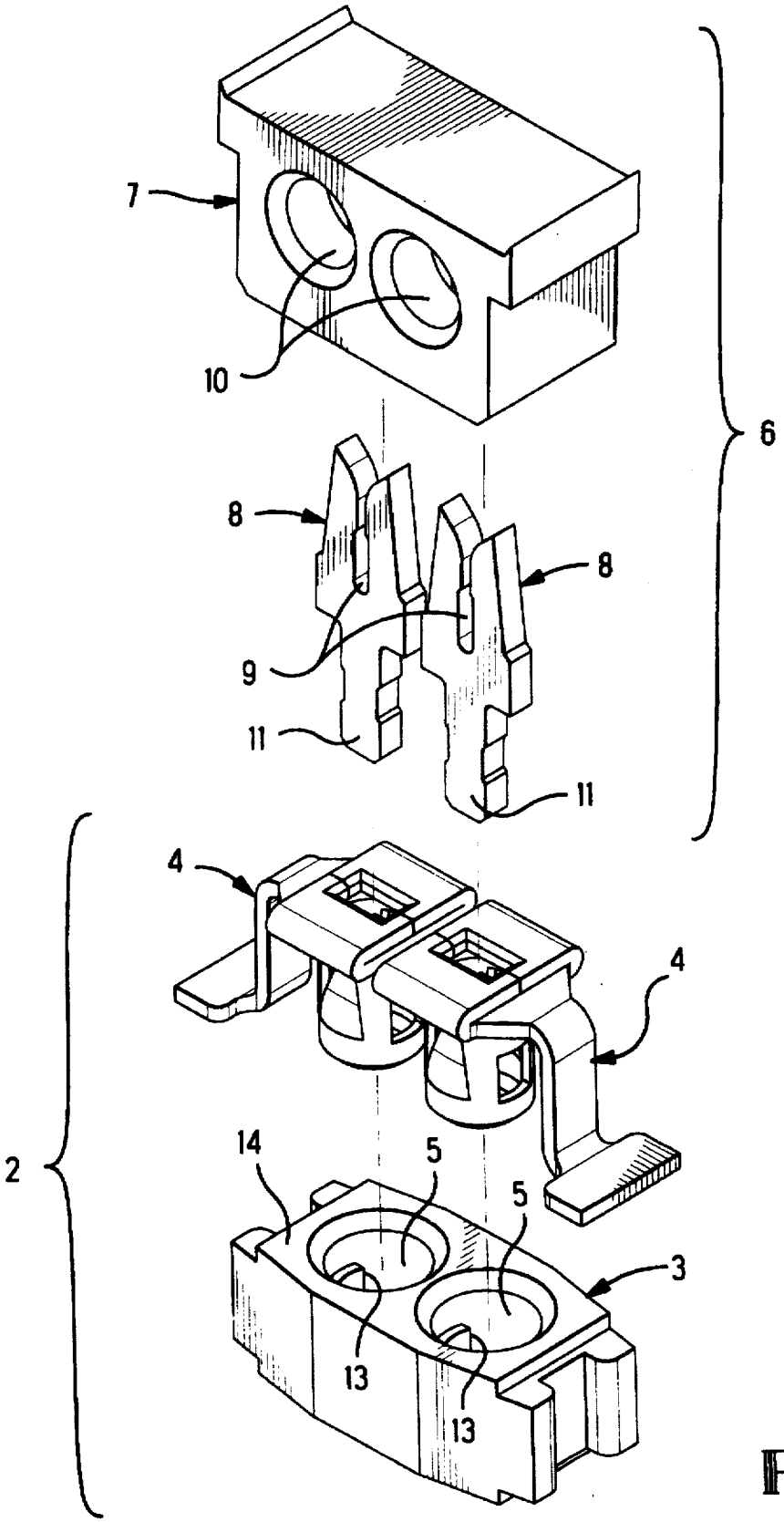
FIG. 1 is an exploded isometric view of an electrical connector assembly, including a receptacle connector and socket contacts according to the invention.
Figure 2:
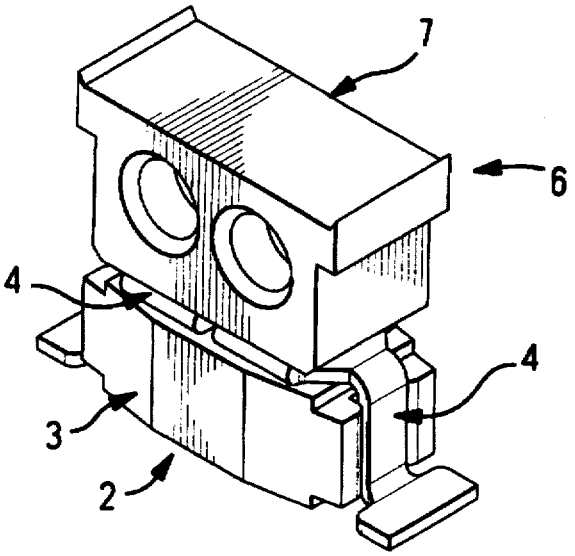
FIG. 2 is a view of the connector assembly in assembled condition.
Figure 3:
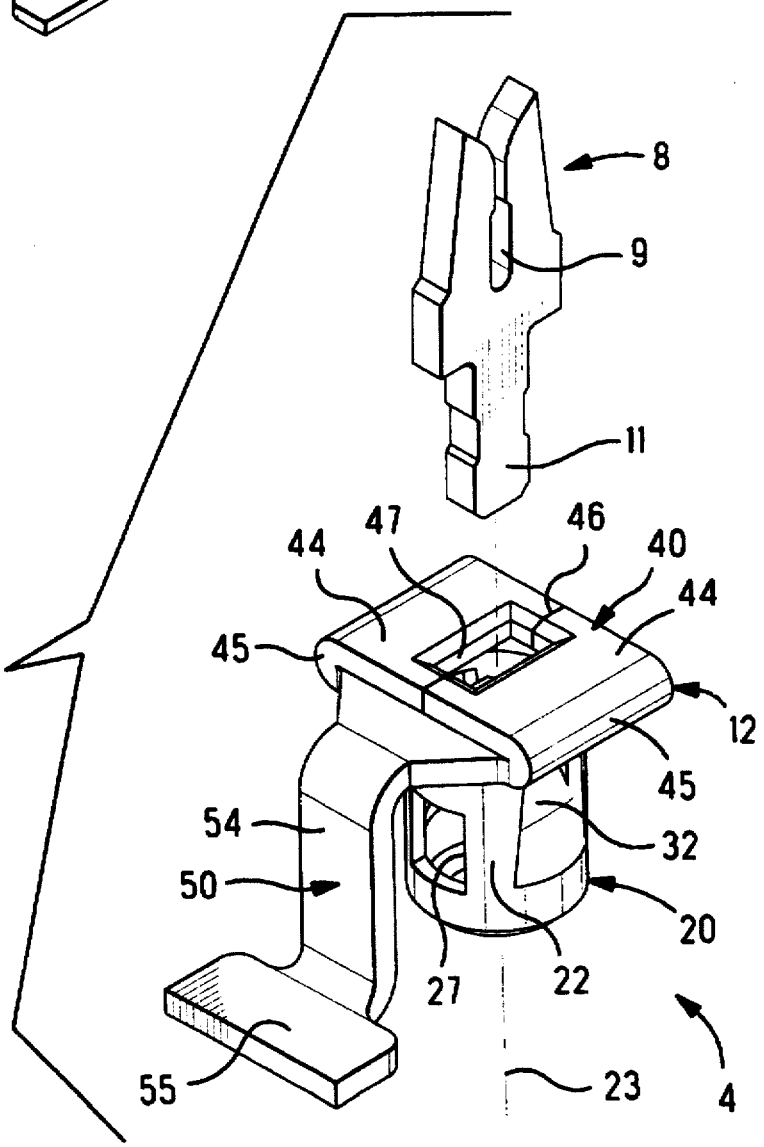
FIGS. 3 and 4 are enlarged isometric views of a socket contact according to the invention; of the socket contact.
Figure 4:
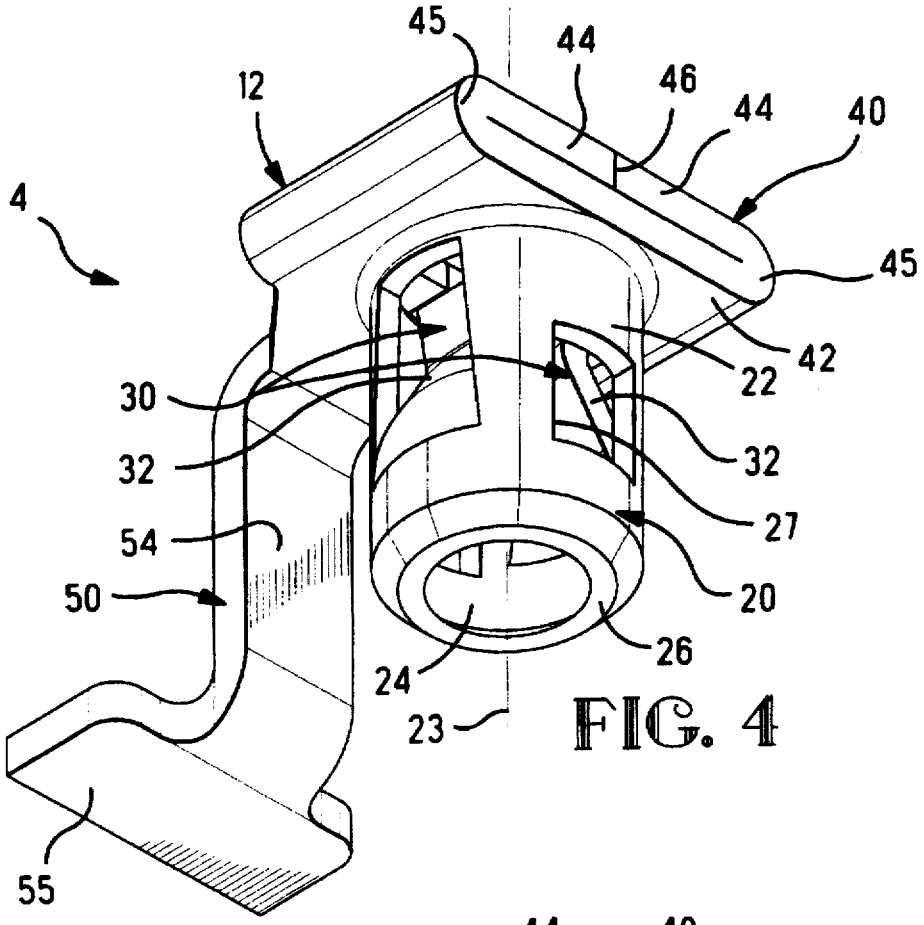
Figure 5:
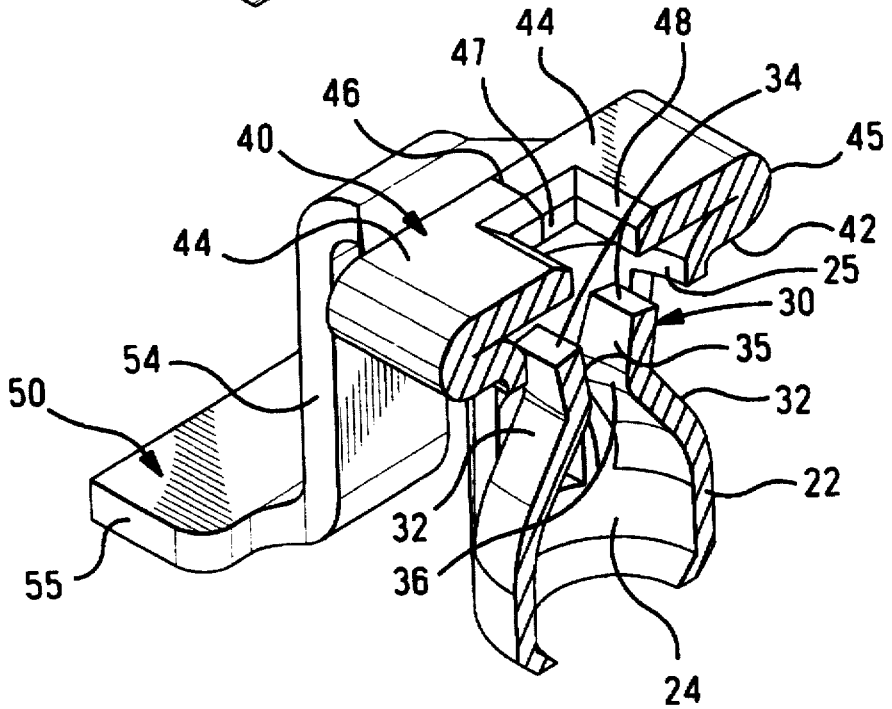
FIGS.5 and 6 are isometric cross-sectional views
Figure 6:
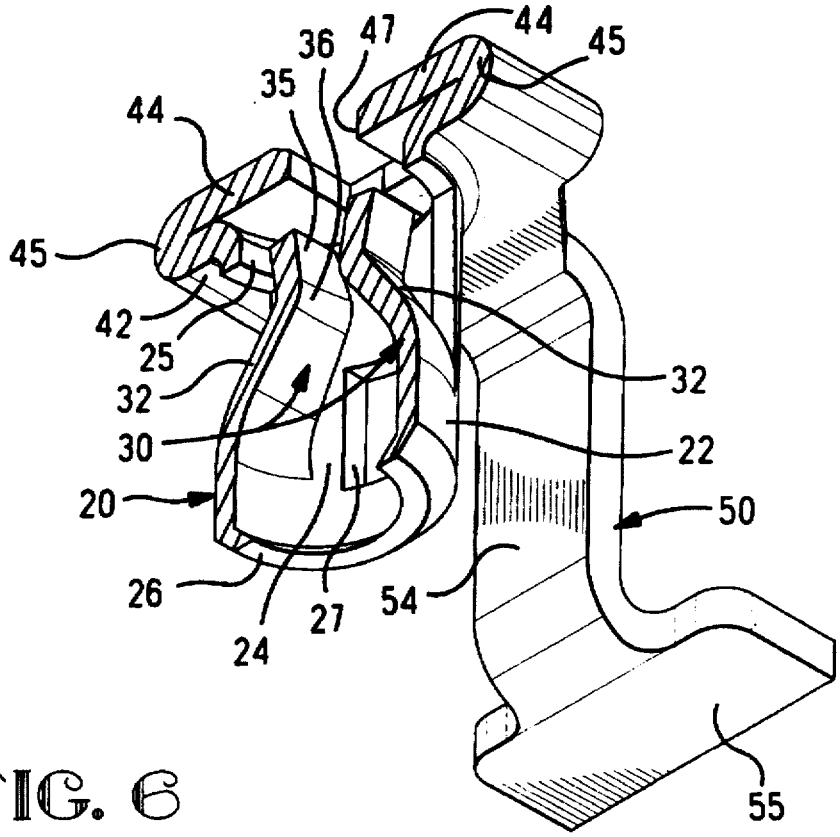

FIG. 1 is an exploded view of an electrical connector assembly comprising a receptacle header 2 and a pin header 6. The receptacle header 2 comprises a dielectric housing 3 which holds socket contacts 4 in respective cavities 5. The receptacle header 2 can be mounted on a circuit board (not shown). The pin header 6 comprises a dielectric housing 7 which holds pin contacts 8 that are matable with the socket contacts 4. Each of the pin contacts 8 has an upper portion with an insulation displacement slot 9 which can terminate a wire installed through a passageway 10 in the housing 7, and a depending pin or lead 11 which is engageable with one of the socket contacts 4. FIG. 2 shows the receptacle header 2 and the pin header 6 in assembled condition. Although the mating headers 2,6 are shown as having two of the contacts 4,8, it should be understood that the headers could be produced with any number of contacts without deviating from the scope of the invention.

One of the socket contacts 4 is shown in several views in FIGS. 3–6. The socket contact 4 comprises a unitary contact body 12 having a tubular body portion 20, spring fingers 30, a shield portion 40, and a solder tab 50. The contact body 12 is formed from a strip of electrically conductive material in a progressive stamping operation wherein dies of appropriate size and shape are used to produce a desired configuration of the body.

The tubular body portion 20 has a wall 22 which surrounds a central axis 23 extending in a longitudinal direction. The wall defines an interior space 24, and the tubular body portion 20 has an open upper end 25 which permits the lead 11 of the mating contact 8 to be inserted longitudinally into the interior space. The lower end 26 of the tubular body portion is optionally open or closed. The wall 22 has windows 27 which are dimensioned to receive blocks 13 extending inwardly from a wall surface of the cavity 5 (shown in FIG. 1) to retain the socket contact 4 in the receptacle housing 3. Alternatively, the tubular body portion 20 could be dimensioned for an interference fit in a cavity having a wall surface without the blocks 13.

The spring fingers 30 extend into the interior space 24 for engagement with the lead 11 of the mating contact. In the preferred embodiment shown, two spring fingers 30 are mutually opposed in the interior space for engaging the lead of the mating contact therebetween. However, it should be understood that the contact body 12 can be formed with a different number of the spring fingers 30, including only one spring finger which could be arranged to bias the lead 11 against an interior surface of the wall 22.

Each of the spring fingers 30 is defined by a wall segment 32 which is struck from the wall 22 and is bent into the interior space 24. The wall segment 32 is a longitudinally extending strip which is connected to the wall 22 near the lower end 26 of the tubular body portion, and the strip extends upwardly to an end 34 which is proximate the open end 25 of the tubular body portion. The spring finger 30 has an angled lead-in portion 35 which promotes deflection of the spring finger during insertion of the lead 11, and a contact nose portion 36 which is configured to engage the lead 11 upon insertion thereof.

The contact body 12 has a flange 42 which extends outwardly from the wall 22 of the tubular body portion. The flange 42 is formed by a flat portion of the material strip from which the contact body is produced. The flange 42 mounts on a top surface 14 of the receptacle housing 3 (shown in FIG. 1).

The shield portion 40 partially covers the open end 25 of the tubular body portion 20 and is arranged to guide the lead 11 of the mating contact into the interior space 24 without stubbing the spring fingers 30.

The shield portion 40 may be formed as a pair of flaps 44 which are connected to the flange 42 at respective reverse bends 45. The pair of flaps 44 have ends 46 which abut over the open end 25, and a cutout 47 in the abutting ends 46 is dimensioned to align and closely guide the lead 11 of the mating contact during insertion. The cutout 47 has a beveled upper wall 48 which serves to initially guide the lead 11 into the cutout. The cutout 47 has a rectangular shape which conforms substantially to the cross-sectional shape of the lead 11. However, the cutout could be configured with a different shape such as circular to conform with a corresponding lead such as a pin of circular cross-section.

Figure 7:
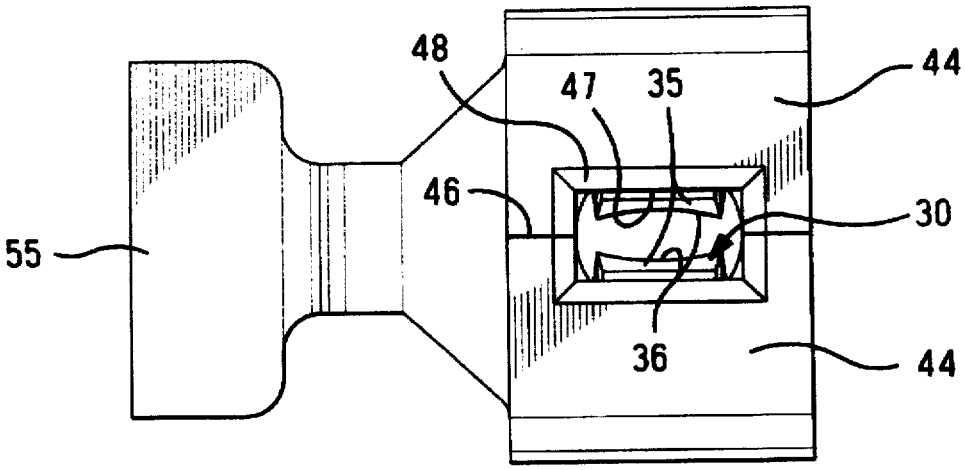
FIG. 7 is a top view of the socket contact.
Figure 8:
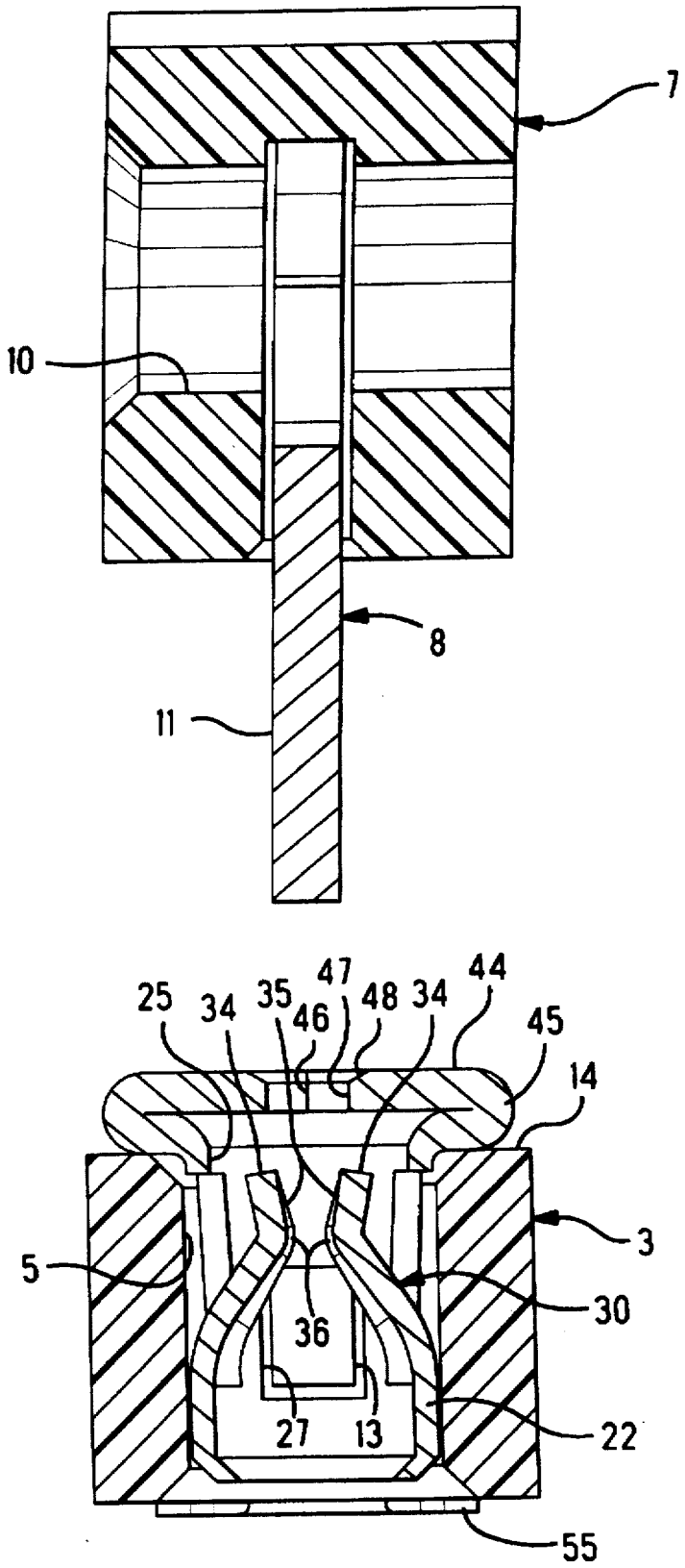
FIG. 8 is a cross-sectional view showing a receptacle connector and socket contact according to the invention, and a mating connector poised for insertion therein.

As shown in FIGS. 7 and 8, the flaps 44 substantially overlie the upper ends 34 of the spring fingers 30 so that mainly the contact noses 36 and the lead-in portions 35 are exposed through the cutout 47. The shield portion 40 thus prevents the lead 11 from jamming on the ends 34 of the spring fingers, which jamming would likely crush and destroy the spring fingers.

The solder tab 50, which is formed by bending a portion of the material strip, extends from the flange 42 downwardly along a leg 54 and terminates in a solder foot 55 which is configured for surface mount soldering to a contact pad on a circuit board. Remoteness of the solder foot 55 from the spring fingers 30 helps to prevent solder wicking which could contaminate the spring fingers and interfere with a good electrical connection.

The invention provides several advantages. The socket contact can be surface mounted on a circuit board, thereby eliminating via holes in the circuit board. The socket contact has spring fingers which converge upwardly, thereby enabling a connector assembly to have a low height. The socket contact has shields which prevent stubbing of the spring fingers. The shields are integrally formed parts of a unitary socket body, and the shields can be formed by flaps of material which add only a small amount to the overall height of the socket contact.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A socket contact comprising:

a unitary contact body including a tubular body portion having a wall which defines an interior space and an open end which permits insertion of a mating contact into the interior space, a spring finger extending into the interior space for engagement with the mating contact, and a shield partially covering the open end, the shield including a pair of flaps having ends which abut over the open end, and a cutout in the abutting ends provides an opening for the mating contact to enter the interior space, whereby the shield guides the mating contact into the interior space and prevents stubbing of the spring finger during insertion of the mating contact.

2. The socket contact according to claim 1, wherein the unitary contact body includes a solder tab.

3. The socket contact according to claim 1, wherein the spring finger is defined by a segment of the wall which is bent into the interior space.

4. The socket contact according to claim 3, wherein the wall segment is a longitudinally extending strip of the wall.

5. The socket contact according to claim 4, wherein the strip has a connection with the wall at a longitudinal distance from the open end, and the strip has a contact portion disposed in the interior space for engaging the mating contact at a relatively shorter longitudinal distance from the open end.

6. The socket contact according to claim 4, wherein a pair of the spring fingers are mutually opposed in the interior space for engaging the mating contact therebetween.

7. The socket contact according to claim 1, wherein a flange extends outwardly from the wall of the tubular body portion.

8. The socket contact according to claim 7, wherein the pair of flaps are connected to the flange at respective reverse bends.

9. An electrical connector comprising:

a dielectric housing holding a plurality of socket contacts, each of the socket contacts comprising a unitary contact body including a tubular body portion having a wall which defines an interior space and an open end which permits insertion of a mating contact of a mating electrical connector into the interior space, a spring finger extending into the interior space for engagement with the mating contact, and a shield partially covering the open end, the shield including a pair of flaps having ends which abut over the open end, and a cutout in the abutting ends provides an opening for the mating contact to enter the interior space, whereby the shield guides the mating contact into the interior space and prevents stubbing of the spring finger during insertion of the mating contact.

10. The electrical connector according to claim 9, wherein the unitary contact body includes a solder tab.

11. The electrical connector according to claim 9, wherein the spring finger is defined by a segment of the wall which is bent into the interior space.

12. The electrical connector according to claim 11, wherein the wall segment is a longitudinally extending strip of the wall.

13. The electrical connector according to claim 12, wherein the strip has a connection with the wall at a longitudinal distance from the open end, and the strip has a contact portion disposed in the interior space for engaging the mating contact at a relatively shorter longitudinal distance from the open end.

14. The electrical connector according to claim 12, wherein a pair of the spring fingers are mutually opposed in the interior space for engaging the mating contact therebetween.

15. The electrical connector according to claim 9, wherein a flange extends outwardly from the wall of the tubular body portion.

16. The electrical connector according to claim 15, wherein the pair of flaps are connected to the flange at respective reverse bends.

17. An electrical connector comprising:

a dielectric housing holding a plurality of socket contacts, each of the socket contacts comprising a unitary contact body including a tubular body portion having a wall which defines an interior space and an open end which permits insertion of a mating contact of a mating electrical connector into the interior space, a spring finger extending into the interior space for engagement with the mating contact, and a shield which is arranged to guide the mating contact into the interior space, the shield including a pair of flaps of material each extending along a respective course first outwardly from the wall of the tubular body portion and then through a reverse bend back toward the wall to a position partially covering the open end, the pair of flaps having ends which abut over the open end, and a cutout in the abutting ends provides an opening for the mating contact to enter the interior space.

* * * * *